United States Patent [19]

Burack et al.

[11] 4,219,976

[45] Sep. 2, 1980

[54] MACHINE AND METHOD FOR DECONTAMINATING NUCLEAR STEAM GENERATOR CHANNEL HEAD

[75] Inventors: Robert D. Burack, Pittsburgh; Robert Shaffer, Swissvale, both of Pa.

[73] Assignee: Westinghouse Electric Corp., Pittsburgh, Pa.

[21] Appl. No.: 930,091

[22] Filed: Aug. 1, 1978

[51] Int. Cl.[2] ..... B24C 3/32; B24C 1/00

[52] U.S. Cl. ..... 51/411; 51/319; 134/167 R; 134/181

[58] Field of Search ..... 51/319, 320, 321, 411, 51/415, 416; 134/8, 24, 167 R, 168 R, 180, 181

[56] References Cited

U.S. PATENT DOCUMENTS

| | | | |
|---|---|---|---|
| 2,628,455 | 2/1953 | Webster | 51/415 |
| 3,072,130 | 1/1963 | Grabenhorst | 134/180 X |
| 3,436,866 | 4/1969 | Nye | 51/416 |
| 3,477,178 | 11/1969 | Hulbert | 51/411 |
| 3,531,964 | 10/1970 | Manning | 51/411 X |
| 3,778,938 | 12/1973 | Korn | 51/320 |
| 3,951,092 | 4/1976 | Broek | 51/415 X |
| 4,097,340 | 6/1978 | Pries | 134/180 X |

*Primary Examiner*—Gary L. Smith
*Attorney, Agent, or Firm*—E. C. Arenz

[57] ABSTRACT

The machine comprises a first assembly including a vertical post and a carriage track with a movable carriage thereon, the carriage track being pivotally secured to the upper end portion of the post so that the assembly can be collapsed to a size permitting entry into the channel head through a manway, with the assembly being sufficiently light in weight to permit its installation in the channel head by no more than two individuals, the machine further including a separate horizontal support beam and a separate curved track which are independently separably secured to the vertical post and to the outer end of the carriage track so that a generally quadrantally shaped frame is provided, the carriage track carrying an adjustable decontamination blaster means, and means are provided for moving the carriage along the carriage track and for swinging the carriage track both horizontally and vertically in the frame so that the decontamination means has the capability of sweeping past substantially all of the interiorly facing walls in the channel head. The method of carrying out the decontamination of all of the interiorly facing walls in the space in the channel head is accomplished by traversing the areas to be decontaminated by energizing selective drive means for successive sweeps at rates corresponding to the area to be traversed and then stepping the blaster means to different positions and varying the sweep rate in accordance with the different position.

8 Claims, 8 Drawing Figures

MACHINE AND METHOD FOR DECONTAMINATING NUCLEAR STEAM GENERATOR CHANNEL HEAD

BACKGROUND OF THE INVENTION

The invention relates to the art of decontamination of the interior of a channel head of a nuclear steam generator for the purpose of providing a reasonably safe environment for other work of retubing the steam generator to proceed.

Problems of dents and potential leaks of heat transfer tubes have been experienced in certain nuclear steam generator installations. Since this poses the possibility of contamination of the secondary heat transfer fluid, replacement of the damaged tubes is required. To accomplish this, devices which can be installed in the channel head of the generator have been and are being developed. Since the primary fluid heated by circulation through the nuclear reactor core contains radioactive particles, the channel head through which the primary fluid flows to and from the heat transfer tubes becomes relatively highly radioactively contaminated. Thus, before apparatus such as is disclosed in U.S. patent applications Ser. Nos. 775,676 (now Continuation Application Ser. No. 908,046) and 873,292 can be installed in the channel head, a way of substantially decontaminating all of the interiorly facing surfaces in the channel head is required to permit the installation of such apparatus and other apparatus for the purpose of effecting tube replacement and associated work.

Accordingly, the aim of this invention is to provide an apparatus and method for accomplishing initial decontamination in the channel head without undue exposure to personnel involved in the decontamination.

SUMMARY OF THE INVENTION

In accordance with the invention the decontamination machine includes a first assembly comprising a vertical post and a carriage track carrying a movable carriage with an adjustable decontamination blaster thereon, the carriage track being pivotally secured to the upper end portion of the post to permit the assembly to be collapsed to a size which permits its entry through the manway of the channel head, with the assembly being sufficiently light in weight to permit its manipulation and installation thereof in the channel head by no more than two individuals in a location in which the vertical post is closely adjacent the vertical center line of the divider wall, the machine further including both a separate horizontal support beam and a separate curved track which are assembled together and to the vertical post to form a generally quadrantal shaped frame, the machine also including means for moving the carriage along the carriage track and for swinging the carriage track both horizontally and vertically so that the decontamination blaster means can be swept past substantially all of the interiorly facing walls of the channel head.

The method of effecting the decontamination contemplates the traversing of the lower face of the tube sheet, the face of the divider wall and the interior facing wall of the channel head by traversing the areas of these walls by energizing selective drive means for successive sweeps along the areas at rates according to the positioning of the blaster means and then repositioning the blaster means by other drive means and traversing at other rates in accordance with the positioning of the blaster means.

DRAWING DESCRIPTION

DESCRIPTION OF THE PREFERRED EMBODIMENT

Figure 1:
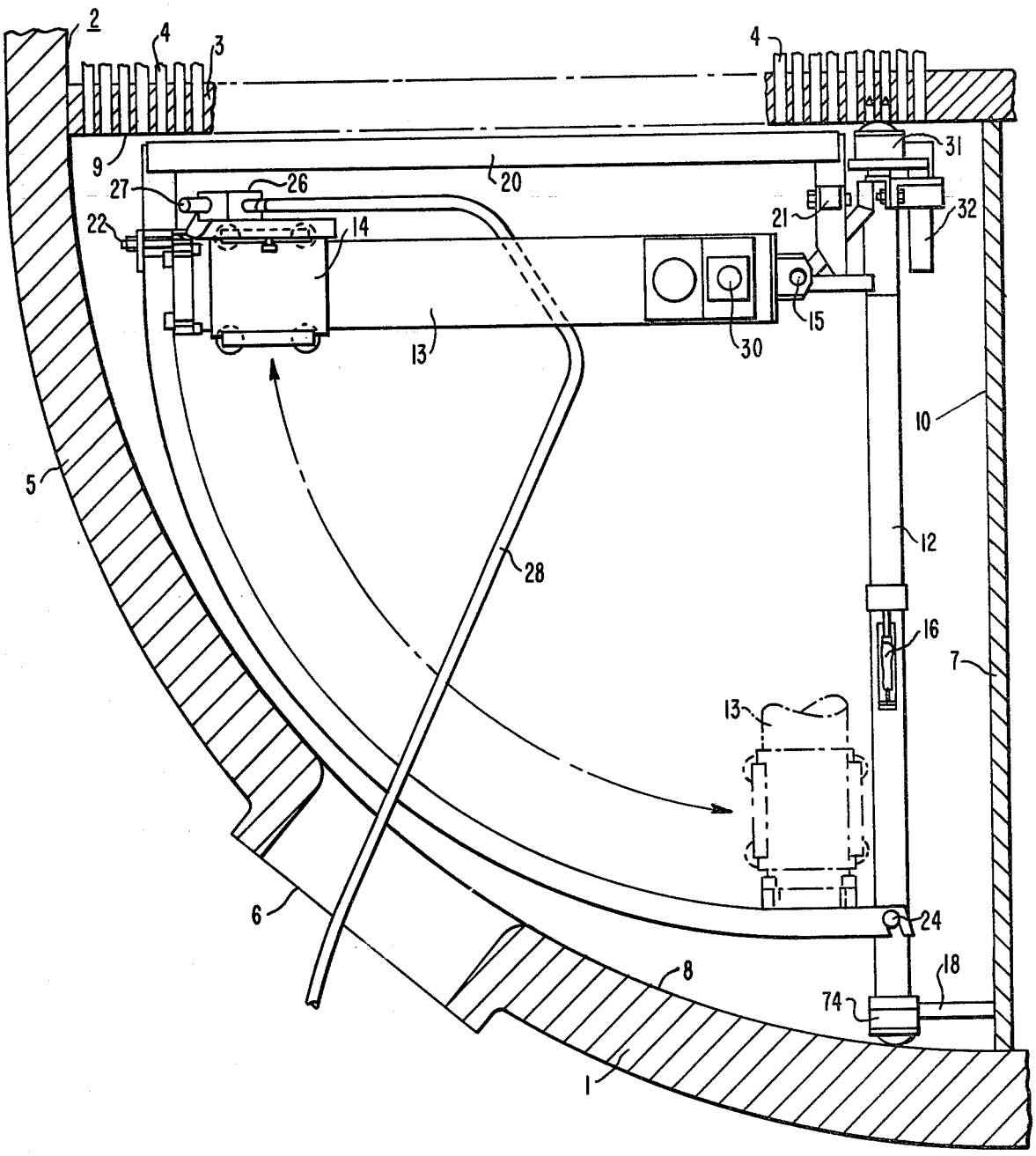
FIG. 1 is a view in vertical section of a channel head of a steam generator with the apparatus of the invention shown in finally installed position in the channel head in elevation.

Referring to FIG. 1, there is a portion of a channel head 1 of a nuclear steam generator 2 which has a horizontal tube sheet 3 receiving the lower ends of a plurality of heat transfer tubes 4 received therein. The channel head 1 has generally spherical walls 5 provided with a manway 6 to provide access to the interior of the channel head. A vertical divider wall 7 separates the channel head 1 into separate inlet and outlet compartments, only one of which is shown in the drawing.

A machine according to the invention is shown installed in the one half of the channel head shown in the drawing. The purpose of the machine is to decontaminate the interiorly facing walls 8, 9, and 10 of the channel head, tube sheet and divider wall, respectively, by systematically cleaning those areas of their oxide surface coating by means of a sand or water and sand grit blast system. This is to be done in order to perform effective long term machining, inspection and modifications within the channel head requiring the presence of individuals in the channel head for similar extended periods of time. Until the decontamination is carried out, the permissible length of exposure to an individual is extremely limited. Therefore the decontamination process is almost necessarily required to be carried out by a machine which is remotely operated, but which must first be installed in the channel head. The machine according to the invention has a design intended to permit its installation into the channel head by a limited number of individuals working in the channel head for a very limited time.

Continuing with reference to FIG. 1, the main parts of the machine will first be described with details of the various parts being described thereafter. The machine includes a first assembly which comprises a vertical post 12 and a carriage track 13 having mounted thereon a movable carriage 14, the radially inner end of the carriage track being pivotally secured at 15 to the upper end portion of the vertical post. This arrangement permits the assembly to be collapsed to a size permitting entry through the manway 6 into the channel head. In the collapsed form, the track 13 lies generally parallel to the vertical post 12 as is shown by the somewhat simplified dash line representation of the position of the track 13 in FIG. 1. To permit the manipulation and installation of the first assembly in the channel head by no more than two individuals, the assembly is designed to be reasonably lightweight with the track and carriage having the main structural parts constructed of aluminum or a similar lightweight material while the vertical post is of reasonably thin wall steel.

The first assembly is installed in a position in which the vertical post 12 is closely adjacent the divider wall and near the vertical center line of the divider wall. The vertical post is effectively locked into place by friction and axial loading through post extender means as indicated by a pair of oppositely disposed toggle means as at 16 or equivalent means, its several projections 17 at the upper end of the post being piloted into tube openings at the top and with the lower end of the post simply seating on the channel wall face 8 and being spaced from the divider wall by a spacer bar 18.

The way the post extension works when a pair of opposite toggle levers are used is as follows. One end of the toggle levers is fixed to the exterior of the post while the other end is attached to a slidable element (not shown) inside the post, which element has one end bearing against a spring pack, such as a series of belleville washers. When the post is properly positioned, the toggle levers are thrown to extend the length of the post and compress the pack so that the post assembly is under compression having a value of about 900 pounds for example. This arrangement is desirable in that the precise channel head depth is not known beforehand and the post must have adequate length to occupy the height plus be under some compression to insrue stability in the operations.

The other parts of the machine which make up the basic frame include a horizontal support beam 20 which has its radially inner end separably secured as at 21 to the upper end portion of the first assembly, and its radially outer end similarly secured as at 22 to the upper end of a curved track 23 which in turn has its lower and radially inner end separably secured at 24 to the lower end portion of the vertical post. Both the horizontal beam 20 and the curved track 23 with their associated fasteners and other ancillary parts are sufficiently lightweight to permit their manipulation and attachment to the first assembly in the channel head by no more than two individuals. The outer end of the carriage track includes means which will be described in somewhat more detail for engaging with the curved track so that the carriage track is capable of having its outer end driven down along the curved track and pivoting about the point 15 so that the carriage track is capable of being moved between its solid line and dash line locations of FIG. 1.

The carriage 14 has attached to it decontamination blaster means 26 which has a pair of directionally adjustable nozzles 27 and which are fed through a line 28 which extends out through the manway 6.

The carriage track is provided with first drive means including an internal chain and sprocket arrangement (to be described in connection with FIG. 3) and powered by a DC drive motor 30 for effecting movement of the carriage 14 along the carriage track. Second drive means generally designated 31 (and which will be described in some detail in connection with FIG. 6) is powered by the second DC drive motor 32 and functions to pivot the intermediate part of the post 12 along with the remainder of the frame through approximately 180 degrees from one position parallel to the dividing wall to the opposite position also generally parallel to the dividing wall. Third drive means (which will be described in connection with FIG. 3) is supported at the radially outer end of the carriage track 13 and functions to move the radially outer end of the carriage track along the curved track 23 between the solid and dash line positions of the carriage track shown in FIG. 1. Third drive means also powered by a DC motor is generally designated 33. Each of the drive motors is independently energizable and at a controlled rate of the motor speed so that the blaster means can be first positioned to a specified location and then swept through an area at the proper rate to provide uniform coverage of the walls to be blasted.

Figure 2:
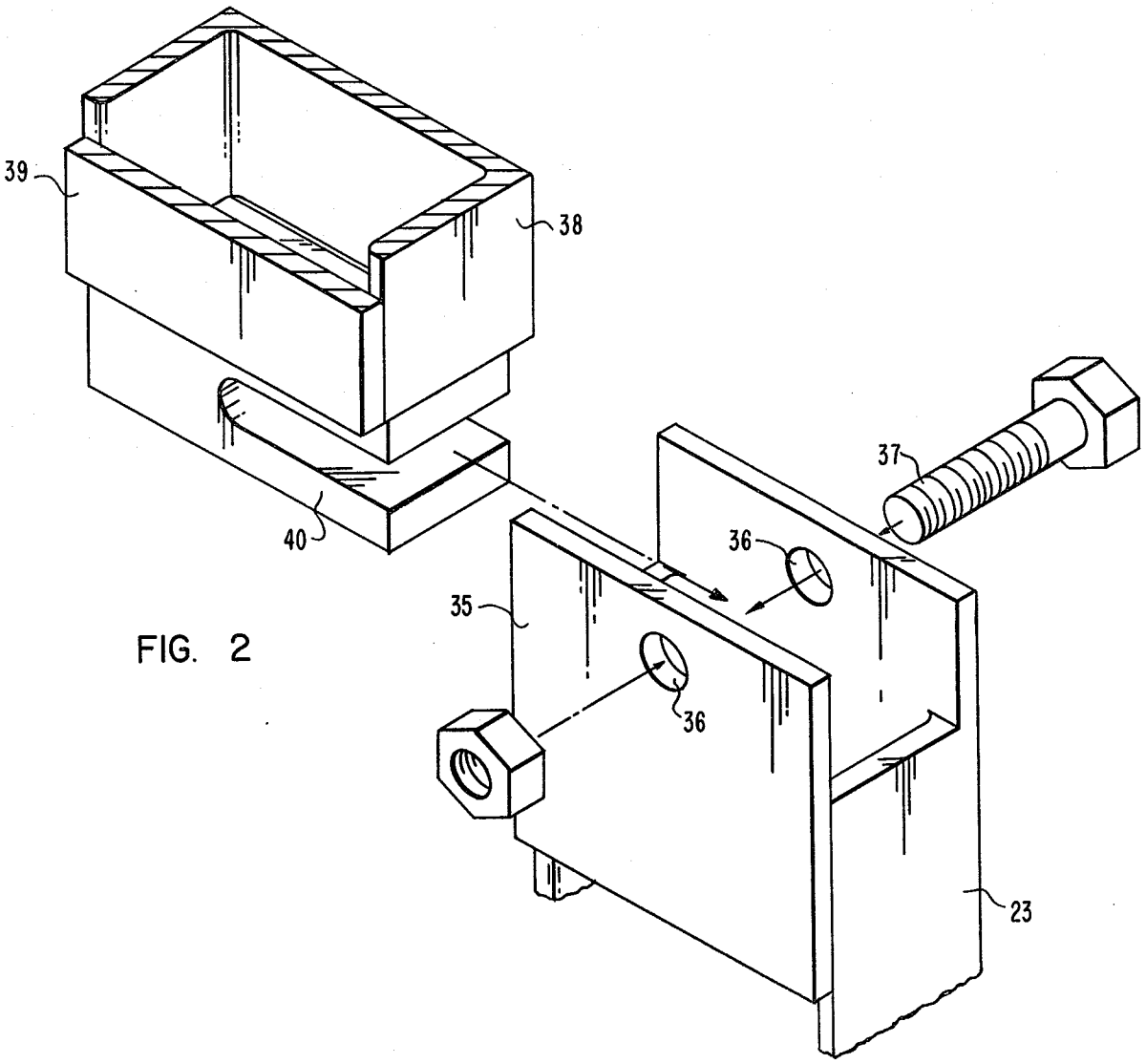
FIG. 2 is a fragmentary isometric view of the upper end portion of the curved track and the outer end portion of the horizontal support beam shown in exploded relation before securement.

Referring now to FIG. 2, the general arrangement by which the separable fastening is effected between the opposite ends of the horizontal support beam to the outer parts of the frame will now be described. The curved track 23 has a shape in transverse section of a channel which is outwardly open. At the upper end of the curved track the legs are cut back as illustrated and a plate 35 is welded to the upper end of the track so that a generally slot shaped end is provided on the track. Aligned holes 36 in the plate 35 and in the web of the track receive the bolt 37, the shank of which extends through the holes. The lower end of the stub leg 38 of the horizontal support beam 20 has a side plate 39 welded to its one side and a slotted block 40 is secured to the bottom end of the stub leg. With this arrangement and with the bolt 37 in place at the upper end of the curved track, the horizontal support beam is slipped into its assembled position with the curved track from the side so that the shank of the bolt is in the horizontal slot of the block 40. The separable fastener arrangement generally designated 21 at the radially inner end of the horizontal support beam is essentially the same as at the fastener location 22 at the radially outer end of the support beam.

Figure 3:
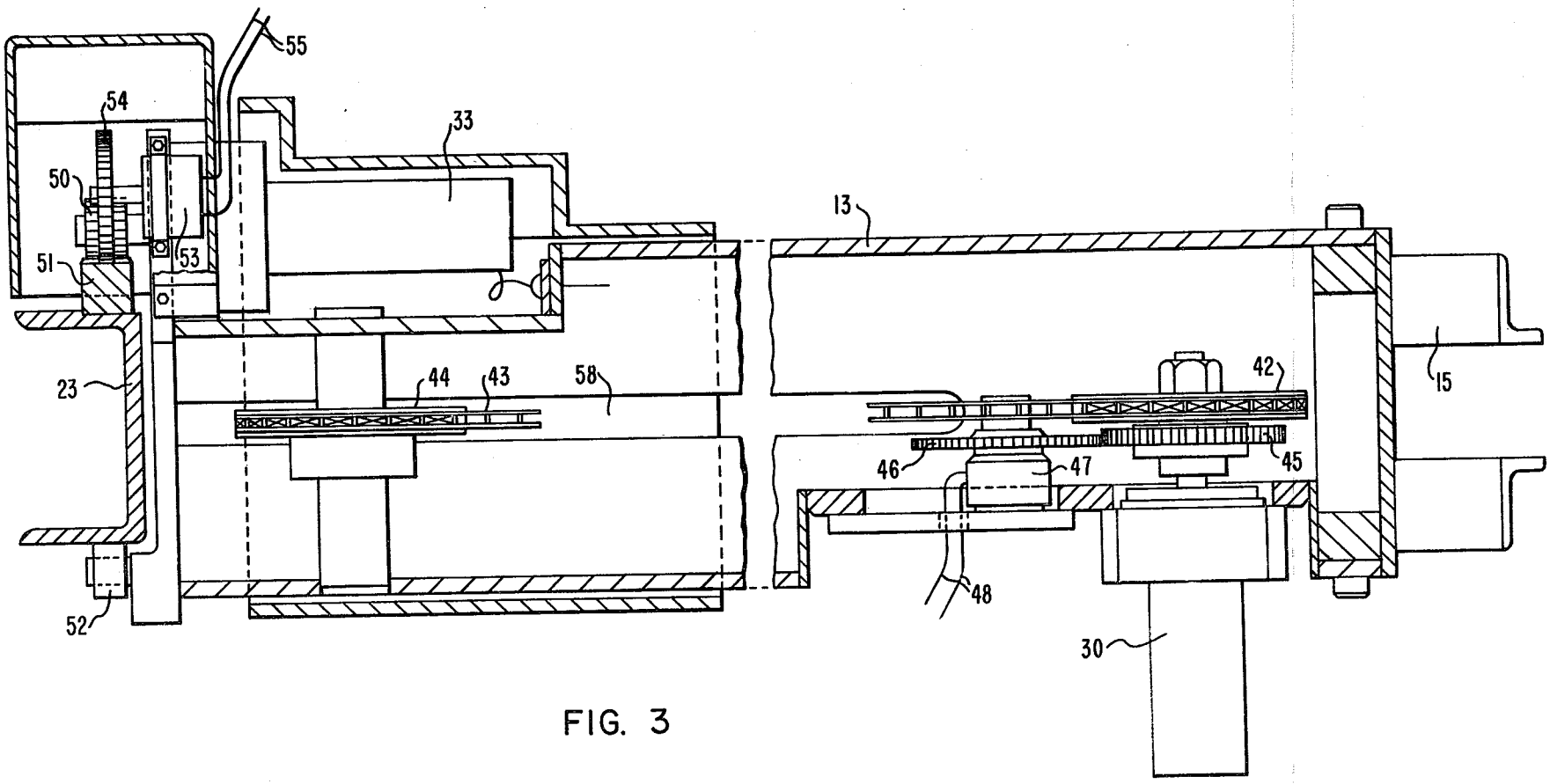
FIG. 3 is a partly broken plan view of the carriage track.

Referring to FIG. 3, the carriage track 13 basically comprises a cast aluminum cylinder with a chain and sprocket arrangement contained therewithin for the purpose of driving the carriage 14 (FIG. 4), which has the general form of a sleeve of greater diameter than the track along the outside of the carriage track. The DC drive motor 30 mounted near the radially inner end of the carriage track rotates a sprocket 42 which drives the endless chain 43 which extends to the radially outer end portion of the carriage track around an idler sprocket 44. Fixed to the motor shaft and therefore rotating with the sprocket is a spur gear 45 which meshes with another spur gear 46 to drive a potentiometer 47 providing a signal through leads 48 to a location outside the channel head indicating the relative location of the carriage on the track.

The arrangement for powering the carriage track to swing vertically along the curved track 23 is located at the outer end portion of the carriage track and comprises a DC drive motor 33 fixed to the carriage track and arranged to turn a pinion gear 50 which meshes with the rack gear 51 fastened to one leg of the channel shaped curved track 23. The outer end of the carriage track also carries an idler wheel 52 which rides along the outer face of the other leg of the curved track so that in the engaging relation of the outer end of the carriage track to the curved track, the curved track and rack gear are generally clamped. A location signal potentiometer 53 rotated by its own spur gear 54 which also meshes with the rack gear 51 provides a remote locational signal through the leads 55 which extend outside the channel head.

Figure 4:
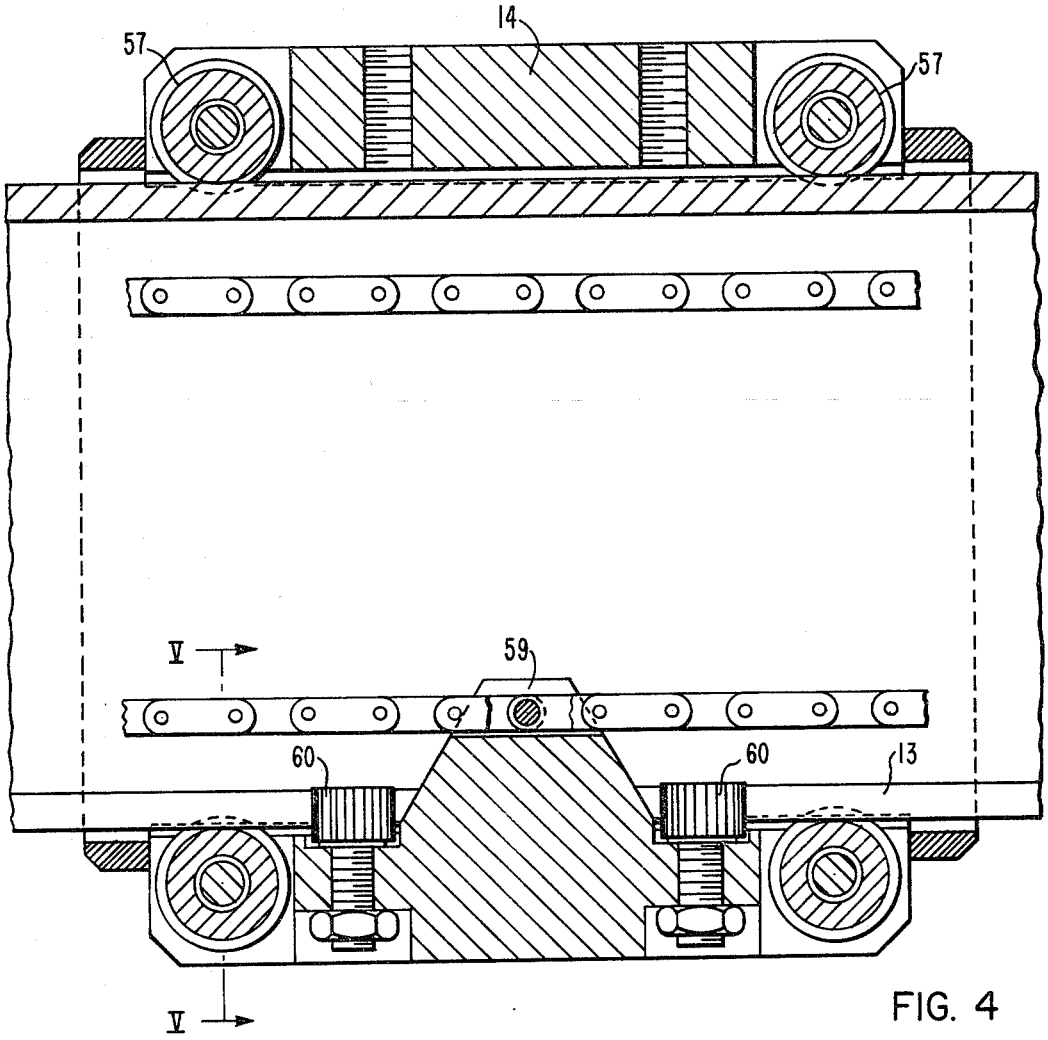
FIG. 4 is a longitudinal section of the carriage and track.
Figure 5:
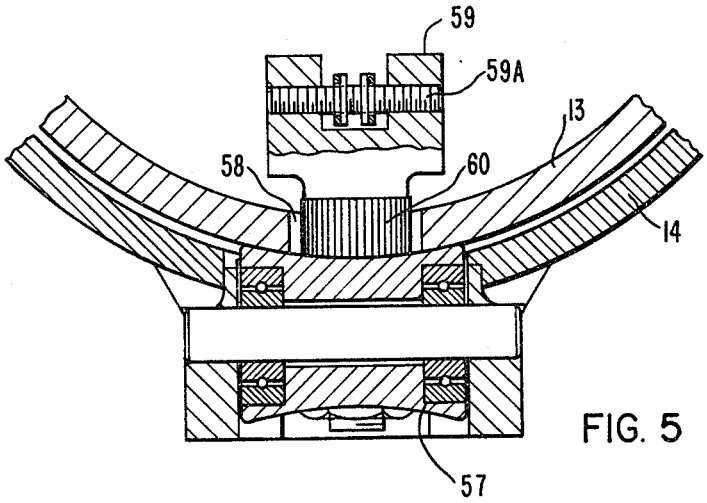
FIG. 5 is a fragmentary section corresponding to one taken along the line V—V of FIG. 4.

Turning now to FIGS. 4 and 5, the carriage 14 as noted before has the general form of a cylindrical sleeve which rides on the outside of the carriage track 13 through four sets of rollers 57. The carriage track 13 is provided with a slot 58 (FIGS. 3 and 5) in its bottom face, and a yoke 59 formed as a part of the carriage 14 projects up through the slot to receive the chain and be pinned thereto by a pair of set screws 59A so that as the chain moves the carriage is pulled along with it. To insure that the carriage tracks smoothly along its track a pair of small idler wheels 60 project up into slot 58 of the carriage track.

Figure 6:
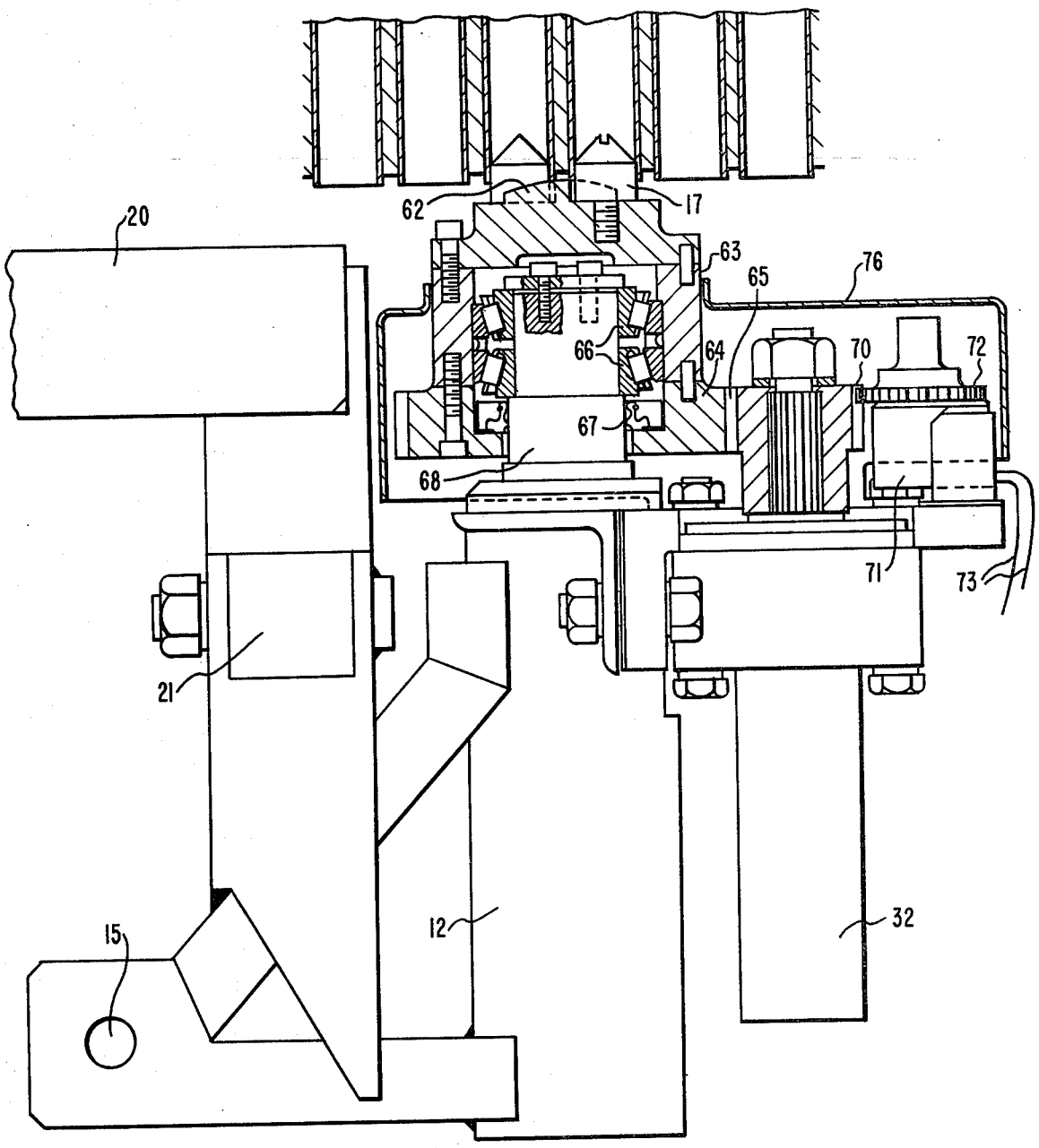
FIG. 6 is a vertical section taken through the drive arrangement which effects rotation of the vertical post relative to its fixed upper and lower ends.

The drive arrangement for turning the intermediate part of the post 12 along with the frame is shown in FIG. 6. The upper end of the vertical post has the general form of a downwardly open cap with the pilot projections 17 fixed thereto extending up into several heat transfer tubes. The cap 62 has a sleeve element 63 fixed to it and the sleeve has a lower ring 64 attached to it. The outer periphery of the ring 64 has gear teeth 65 cut into it with all of the elements 62–65 fixed to each other and thereby being stationary. The sleeve and ring house bearings 66 and seals 67 which receive the rotatable upper end 68 of the vertical post 12.

The motor 32 is fixed through its mounting arrangement 69 to the rotatable intermediate part of the vertical post so that as the motor rotates the spur gear 70 which meshes with the fixed gear 65, the intermediate part of the post and the motor assembly will rotate about the fixed upper parts 62–65. A potentiometer 71 driven by gear 72 meshing with the gear 70 provides an angular location signal conveyed through leads 73 to a control location outside the channel head.

The general arrangement of the parts 62–65 for rotatably receiving the upper end 68 of the post is essentially duplicated in the part 74 (FIG. 1) to receive the rotatable bottom end of the intermediate part of the post 12.

Each of the DC drive motors is shielded by its external can, and the associated gearing associated with them is shielded to reduce the likelihood that grit flying around from the decontamination process will jam the gearing. The gears for the first drive 30 are within the track 13 (FIG 3), the cover 76 (FIG. 6) shields the second drive, and cover 77 (FIG. 3) shields the third drive. Additionally, for the most part the gear engagements are relatively loose to accommodate the extent that some grit will get to the gears.

Figure 8:
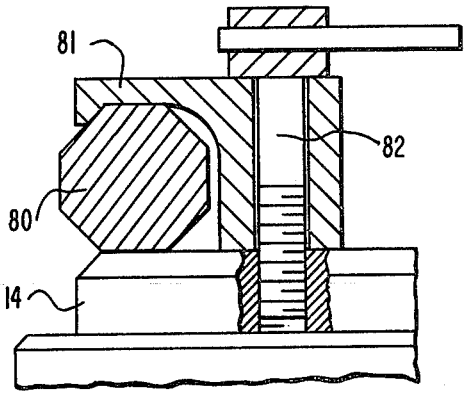
FIG. 8 is a side view partly in section showing how the blaster means is mounted to the carriage.
Figure 7:
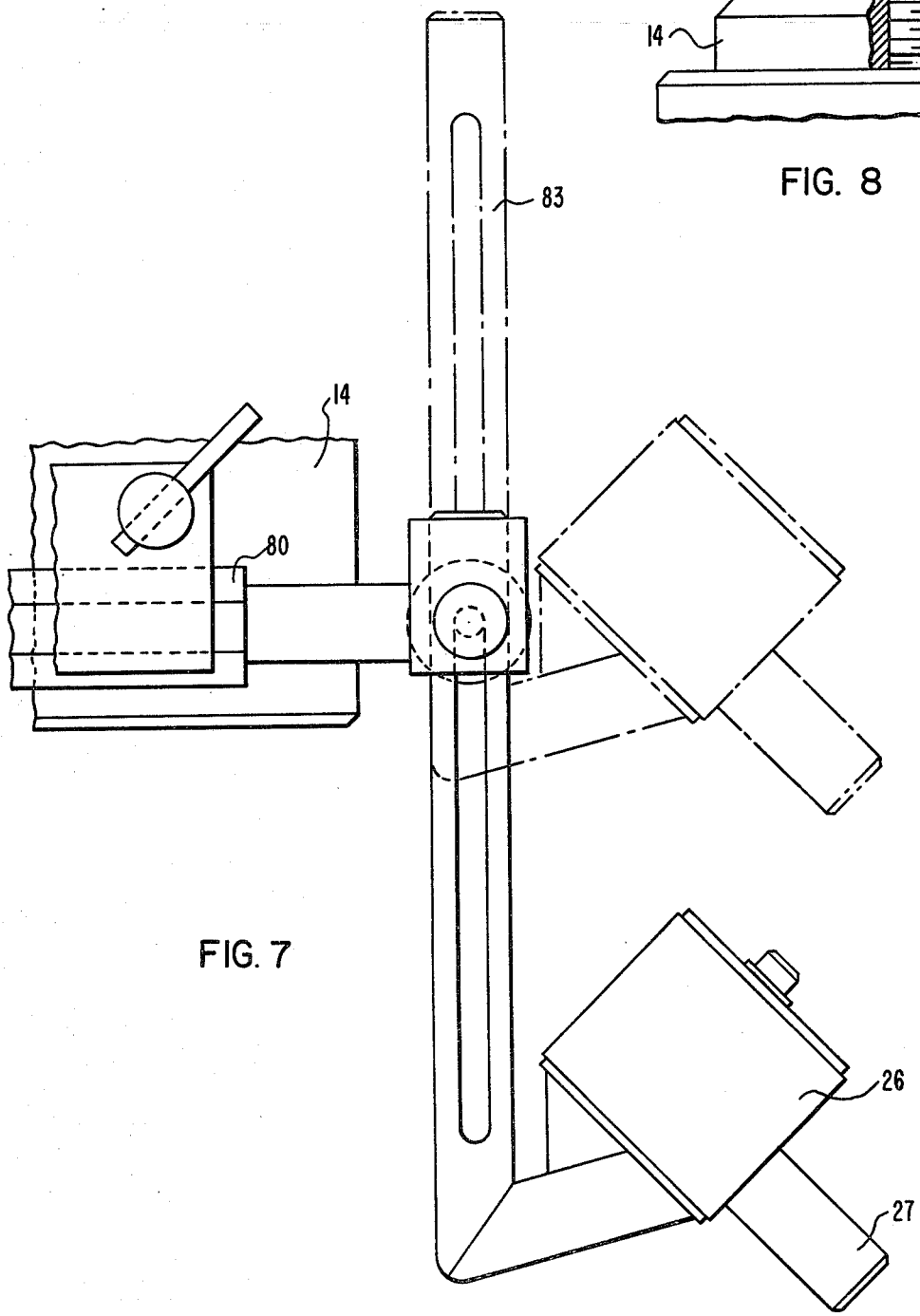
FIG. 7 is a plan view of half of the blaster means as mounted on the carriage, including a phantom view showing a nozzle in a alternate position.

Referring now to FIGS. 7 and 8, the blaster means is mounted to the top of the carriage 14 and includes a pair of nozzle heads with each nozzle being directed outwardly at a 45 degree angle, one on each side of the carriage. A bar with an octagonal cross section 80 is clamped to the top of the carriage by the bracket 81 and bolt 82. The outer ends of the bar 80 slidably mount the slotted bars 83 which carry the blasters. By loosening the connection between the bars 80 and 83, the blasters may be moved from their solid line positions to the phantom positions. The retracted or phantom positions are used when the tube sheet is to be decontaminated. To change the direction in which the nozzles point with respect to the vertical, the bolt 82 is loosened so that the bar 80 may be rotated to any alternate disposition 45 degrees from adjacent dispositions. These manual adjustments permit the nozzles to be aimed in directions to cover all interior areas of the walls.

The way in which the machine is operated to accomplish the decontamination will now be described. The interiorly facing walls which must be traversed include the face 9 of the tube sheet, the face 10 of the divider wall 7, and the bowl shaped face 8 of the channel head. To traverse the tube sheet face 9 the carriage 14 is first located at one of its extreme positions which may be assumed to be the outer position for present purposes and the nozzles 27 pointed upwardly toward the tube sheet. The traverse can start from either side in which the frame is generally parallel to the plane of the divider wall. The second drive motor 32 is energized to turn the intermediate part of the post and the frame moves along to an opposite position, 180 degrees approximately from its starting position. The motor is energized to operate at a rate according to the radial position of the carriage on the carriage track. Thus, with the carriage at its outermost limit, so that in one 180 degree sweep the longest stretch of tube sheet face is to be covered, the angular velocity of the frame is at its lowest value. After the frame is swept 180 degrees the carriage drive motor is energized to reposition the carriage radially inwardly one step. The second drive motor for swinging the frame horizontally is again energized but at a faster rate since the total distance traversed by the blasting means through a 180 degree sweep is less than with the first sweep. This sequence continues until the entire lower face of the tube sheet has been swept with the carriage being successively stepped radially inwardly.

To then sweep the face 10 of the divider wall, the frame is then swung to one of its opposite positions paralleling the plane of the divider wall. The third drive means 33 is energized for making arcual sweeps along the divider wall through a right angle between the tube sheet and the vertical center line of the divider plate. After each sweep, the first drive motor moving the carriage along the carriage track is energized to step the the carriage to a successive position. As in the case of the sweeps along the tube sheet, the third drive means is energized to produce an angular rate in accordance with the position of the carriage 14 on the carriage track. In other words, the angular rate is progressively faster as the carriage is moved in toward the post.

To traverse the inner faces of the channel head the carriage is positioned at its radially outer position and the sweep is accomplished by energizing the second motor means which turns the frame between its opposite positions generally parallel to the divider wall. After each sweep the third drive means 33 which moves the outer end of the carriage track along the curved track 23 is energized to produce the steps along the curved track. Again, the energization of the second drive means is varied to produce the proper speed for the area being covered by the sweep.

In all cases, when the angle of the nozzles is to be changed the carriage 14 is brought to a position adjacent the manway 6 for a manual adjustment.

While the traversing for decontamination purposes has been described basically with respect to the main parts of the three inwardly facing walls, it will be appreciated that the nozzle may also be adjusted and the drive means energized in ways to direct blasting grit into corner areas within the channel head.

We claim:

1. A decontamination machine for decontaminating substantially all of the interiorly facing walls on one side of a divider wall in a channel head of a nuclear steam generator having a manway, comprising:

a first assembly comprising a vertical post and a carriage track carrying a movable carriage, said carriage track being pivotally secured to the upper end portion of said post to permit the assembly to be collapsed to a size permitting entry through said manway into said channel head, said assembly being sufficiently lightweight to permit the manipulation and installation thereof in said channel head by no more than two individuals in a location in which said vertical post is closely adjacent the vertical center line of said divider wall;

a horizontal support beam including fastener means at its radially inner end adapted to be separably secured to the upper end portion of said vertical post;

a curved track shaped to complete a generally quadrantal shaped frame also including said post and said beam, said curved track means including fastener means at both ends adapted to be separably secured to the radially outer end of said horizontal beam and the lower end portion of said vertical post, said curved track engaging the outer end of said carriage track in movable relation;

both said beam and said curved track also being sufficiently ligthweight to permit their manipulation and attachment to said first assembly by no more than two individuals;

adjustable decontamination blaster means attached to said carriage; and means for moving said carriage along said carriage track, and means for swinging said carriage track both horizontally and vertically so that said decontamination means has the capability of sweeping past substantially all said interiorly facing walls of said channel head.

2. A decontamination machine according to claim 1 wherein:

said carriage moving means comprises a first DC drive motor;

said means for swinging said carriage track horizontally comprises a second DC drive motor; and said means for swinging said carriage track vertically comprises a third DC drive motor.

3. A machine according to claim 2 wherein:

said first and third drive motors are carried by said carriage track; and said second drive motor is carried by said post.

4. A machine according to claim 1 wherein:

said vertical post is vertically extensible for wedging said post into a vertical position closely adjacent the middle area of the dividing wall.

5. A machine according to claims 2 or 3 including:

means to energize each of said DC motors independently and to control their speed.

6. A machine according to claims 2 or 3 including:

means for shielding each of said DC motors and associated gearing to protect from decontamination blasting material.

7. A machine for decontaminating substantially all of the interiorly facing wall surfaces on one side of a divider wall and a channel head, having a manway, of a nuclear steam generator, comprising:

a machine frame which, as assembled in the space in said channel head, is generally quadrantal in outline and includes a vertical post, a horizontal support beam, and a curved track forming the outline, both the support beam and the curved track being separably secured to said vertical post and to each other, the support beam having its inner end secured to the upper end portion of the post, and the curved track having its lower inner end secured to the lower end portion of said post;

a carriage track having its radially inner end pivotally secured to the upper end portion of said vertical post, and its radially outer end engaging said curved track, so that said track can be pivoted from a position generally paralleling said support beam to a position generally paralleling said vertical post;

a carriage movable in a longitudinal direction on said carriage track;

decontamination means carried by said carriage, said decontamination means including nozzle means adjustable to a number of different angular positions;

first drive means for moving said carriage along said carriage track;

second drive means carried by said vertical post for pivoting the intermediate part of said post through approximately 180 degrees from one position parallel to said dividing wall to the opposite position also generally parallel to the dividing wall; and third drive means carried by said carriage track for moving the outer end of said track along said curved track.

8. The method for decontaminating substantially all the interiorly facing walls of a space defined by an upper tube sheet, a divider wall and a channel head wall of a nuclear steam generator, with a directionally adjustable blast nozzle carried by a carriage on a track, with the blast nozzle being movable radially in and out on the track by one drive, and the track being swingable horizontally by a second drive, and swingable vertically by a third drive, comprising:

traversing the area of said tube sheet by energizing said second drive for successive sweeps at a rate according to the radial position of said carriage on said track, and energizing said one drive between successive sweeps to position said carriage on said track;

traversing the area of said divider wall by energizing said third drive for successive sweeps at a rate according to the radial position of said carriage on said track, and energizing said one drive between these successive sweeps to position said carriage on said track;

positioning said carriage at its radially outer position and then traversing the area of said channel head wall by energizing said second drive for successive sweeps at a rate according to the length of each of these sweeps along the channel head wall, and energizing said third drive between these successive sweeps to successively step said track between opposite generally horizontal and generally vertical positions.

* * * * *